US008365648B2

(12) United States Patent
Kocher

(10) Patent No.: US 8,365,648 B2
(45) **Date of Patent: *Feb. 5, 2013**

(54) HIGHLY SURVIVABLE URBAN UTILITY VEHICLE (HSUUV)

(75) Inventor: Robert William Kocher, Arlington, VA (US)

(73) Assignee: The Right Problem LLC, Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/153,269

(22) Filed: May 15, 2008

(65) Prior Publication Data

US 2009/0025547 A1 Jan. 29, 2009

Related U.S. Application Data

(63) Continuation of application No. 11/507,089, filed on Aug. 21, 2006, now Pat. No. 7,401,540.

(60) Provisional application No. 60/708,771, filed on Aug. 17, 2005.

(51) Int. Cl.
*F41H 7/02* (2006.01)

(52) U.S. Cl. ..... 89/36.08; 89/929

(58) Field of Classification Search ..... 89/36.08, 89/36.11, 36.14, 36.15, 36.06, 36.16, 36.17, 89/36.07–36.09, 929

See application file for complete search history.

(56) References Cited

U.S. PATENT DOCUMENTS 1,273,515 A * 7/1918 Makrenos ..... 109/81
2,051,753 A * 8/1936 Steckly ..... 296/24.43
2,871,763 A * 2/1959 Blomquist ..... 89/36.08
3,261,263 A * 7/1966 Hilfing et al. ..... 89/36.08
3,395,672 A * 8/1968 Ruf ..... 440/12.6
3,855,898 A * 12/1974 McDonald ..... 89/36.08
4,158,986 A * 6/1979 Appelblatt et al. ..... 89/36.08
4,159,669 A * 7/1979 Jackson et al. ..... 89/36.14
4,280,393 A * 7/1981 Giraud et al. ..... 89/36.08
4,316,404 A * 2/1982 Medlin ..... 89/36.08
4,326,445 A * 4/1982 Bemiss ..... 296/187.07
4,351,558 A * 9/1982 Mueller ..... 296/203.01
4,398,446 A * 8/1983 Pagano et al. ..... 89/36.08
4,741,244 A * 5/1988 Ratner et al. ..... 89/36.17
4,841,838 A * 6/1989 Scully et al. ..... 89/36.08
5,307,725 A * 5/1994 Desmond et al. ..... 89/36.14
5,499,568 A * 3/1996 Turner ..... 89/36.08
5,637,824 A * 6/1997 Benyami ..... 89/36.17
5,663,520 A * 9/1997 Ladika et al. ..... 89/36.08
5,847,308 A * 12/1998 Singh et al. ..... 89/36.08

(Continued)

OTHER PUBLICATIONS

Jane's Defense Weekly (JDW) see attached.*

(Continued)

*Primary Examiner* — Michael Carone
*Assistant Examiner* — Reginald Tillman, Jr.
(74) *Attorney, Agent, or Firm* — Marc S. Kaufman; Gerard M. Donovan; Reed Smith LLP

(57) ABSTRACT

The Highly Survivable Urban Utility Vehicle (HSUUV) provides a novel way to balance the concerns of armor, mobility and cost. Prior art distributes armor to protect all areas of the vehicle evenly, thereby distributing the maximum armor weight capacity evenly. The HSUUV provides armored protection in levels, which vary depending on the location of the armor and that location's ballistic threat. Entrance to the HSUUV is located in location(s) other than the traditional side door(s) so as to provide additional armored protection in the area receiving the greatest ballistic threat. Using the HSUUV, soldiers can safely and quickly enter areas that they otherwise would have had to fight and sustain casualties to enter. The vehicle will give United States forces an unprecedented amount of flexibility, allowing for better strategic and tactical decisions.

12 Claims, 4 Drawing Sheets

U.S. PATENT DOCUMENTS

| | | | | |
|---|---|---|---|---|
| 5,861,569 | A * | 1/1999 | Abels | 89/36.08 |
| 5,866,839 | A * | 2/1999 | Ohayon | 89/36.08 |
| 6,302,010 | B1 * | 10/2001 | Holler | 89/36.08 |
| 6,327,954 | B1 * | 12/2001 | Medlin | 89/36.08 |
| 6,595,575 | B2 * | 7/2003 | Morris | 296/136.02 |
| 6,658,984 | B2 * | 12/2003 | Zonak | 89/36.08 |
| 7,114,764 | B1 * | 10/2006 | Barsoum et al. | 296/193.07 |
| 7,222,562 | B2 * | 5/2007 | Smiley | 89/36.08 |
| 7,225,717 | B2 * | 6/2007 | Williams | 89/36.08 |
| 7,228,927 | B2 * | 6/2007 | Hass et al. | 180/65.25 |
| 7,357,062 | B2 * | 4/2008 | Joynt | 89/36.08 |
| 7,401,540 | B1 * | 7/2008 | Kocher | 89/36.08 |
| 7,695,053 | B1 * | 4/2010 | Boczek et al. | 296/187.12 |
| 8,096,223 | B1 * | 1/2012 | Andrews | 89/36.02 |
| 2005/0087064 | A1 * | 4/2005 | Cohen | 89/36.04 |
| 2005/0115395 | A1 * | 6/2005 | Chassillan | 89/36.08 |

OTHER PUBLICATIONS

Kocher, "Highly Survivable Urban Utility Vehicle (HUV), An idea for a commercial based, fast, low cost, highly survivable vehicle," Briefing to DARPA ATO, Proposal submitted by Ideal Innovations, Inc., Aug. 16, 2005, slides 1-17.

* cited by examiner

HIGHLY SURVIVABLE URBAN UTILITY VEHICLE (HSUUV)

CROSS-REFERENCE TO RELATED APPLICATIONS

This application is a continuation of prior U.S. application Ser. No. 11/507,089, filed on Aug. 21, 2006, now U.S. Pat. No. 7,401,540, and claims priority to said application and patent.

Provisional Patent Application: 60/708,771; Filed Aug. 17, 2005

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION (1) Field of the Invention

This invention relates to the armoring of wheeled vehicles to better protect the vehicle's occupants from various types of threats and attacks.

(2) Description of Related Art

A central problem in the field of military vehicles is the difficulty in armoring. Effective armoring inherently consumes much of a vehicle's load carrying capacity, making for decreased mobility, decreased vehicle life, and increased cost. Current art, such as HMMWVs (High-Mobility, Multi-Purpose Wheeled Vehicles) modified with armor kits or armored HMMWVs, essentially creates a box of armor surrounding the occupants of the vehicle, distributing the armor evenly around the exterior of the vehicle. While the occupants are evenly protected from attack from all angles, the level of this protection is relatively low. Current art is particularly unable to defeat roadside improvised explosive devices (IEDs), other explosive munitions such as rocket propelled grenades (RPGs), and armor piercing rounds. This failure results in the deaths of many US soldiers as well as tactical difficulties. Not only is current art relatively ineffective at protecting the occupants of the vehicle, but these vehicles are highly recognizable to enemy forces, often very slow, and are very costly.

BRIEF SUMMARY OF THE INVENTION

The object of the Highly Survivable Urban Utility Vehicle (HSUUV) is to provide soldiers with a vehicle that is effective at protecting them from IEDs, explosive munitions and armor piercing rounds. One major advantage of the HSUUV is the speed and mobility of the vehicle, due to its concentration of innovative armor. Another advantage is its relatively low cost, which will allow for a large deployment of these vehicles.

The HSUUV (Highly Survivable Urban Utility Vehicle) is a truly innovative approach to solving high levels of ballistic threat protection problems, and other applications that require relatively fast, and inconspicuous armored vehicles. Through the use of an innovative armor system and commercial vehicles, such as flat-bed trucks, the HSUUV offers a novel solution to the problem of having an armored vehicle that is both highly mobile and heavily armored.

The HSUUV consists of a commercial vehicle, heavily modified to protect the occupants, but modified in a very novel way. Instead of evenly protecting the interior of the vehicle with relatively thin armor or lower protection levels all around the cab of the vehicle, the HSUUV utilizes extremely thick side armor. The front and rear of the HSUUV can be armored as well, but much less so, while the bottom can also fitted with limited protection as well with an under armor pan. The main-heavy armor is specifically designed to protect the driver and passengers from the most likely attack in the intended conditions of use, that is, from a side attack, such as an ambush as the vehicle speeds by. In these conditions, the HSUUV could withstand being attacked by significantly higher threats that would normally destroy conventional vehicles; and, due to its relatively low weight, it could quickly get away from the threat. Instead of trading heavy armoring for load carrying capacity and speed, the HSUUV reaches a compromise of heavy armoring only where it is necessary, which allows it to be both well protected and highly mobile.

ITEMS

Item 1 is the front of the HSUUV.

Item 2 is the special HSUUV side armor.

Item 3 is a reinforced windshield.

Item 4 is a rear entry to the HSUUV.

Item 5 is the HSUUV under-armor.

Item 6 is Kevlar Liner or other liner.

Item 7 is 7039 Aluminum or other light metal aluminum armor.

Item 8 is Rolled Homogeneous Armor Steel (RHA) or similar armor.

Item 9 is an Explosive Reactive Armor (ERA).

Item 10 is firing zone A, where the most fire or greatest threat is anticipated.

Item 11 is firing zone B, the front of the vehicle.

Item 12 is firing zone C, the back of the vehicle.

Item 13 is firing zone D, the bottom of the vehicle.

Item 14 is a top entry to the HSUUV.

DETAILED DESCRIPTION OF THE INVENTION

Figure 1:
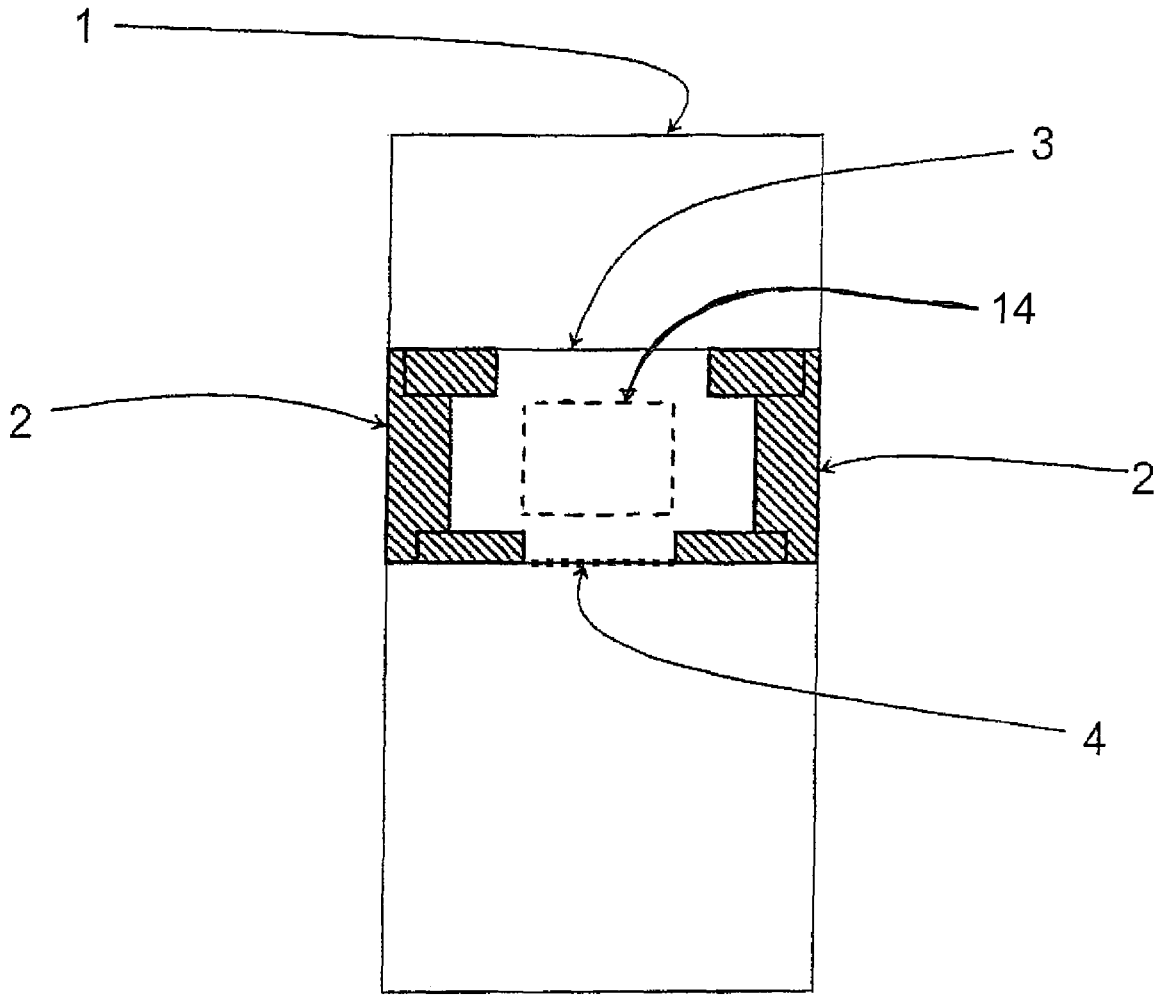
FIG. 1 shows a top down view of the HSUUV

Description—FIG. 1 —

FIG. 1 depicts a top down view of the HSUUV, with a reinforced windshield 3 on the front 1. On the sides, extending to cover the occupants is the specially designed HSUUV side armor 2. In the rear of the cab is an entrance 4. On the top of the cab is an entrance 14.

Figure 2:
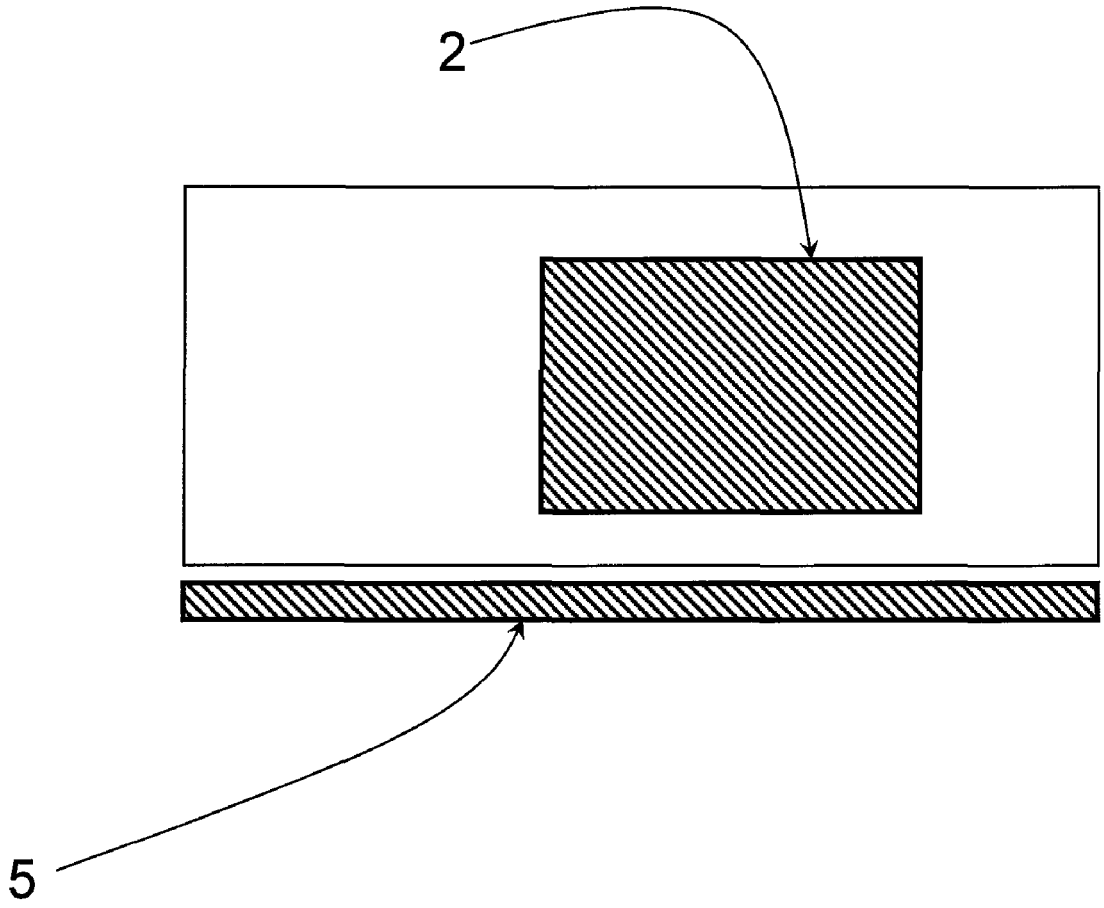
FIG. 2 shows a side view of the HSUUV

Description—FIG. 2—

FIG. 2 depicts a side view of the HSUUV. There is side armor 2 protecting the occupants, as well as under-armor 5 protecting the bottom of the vehicle.

Figure 3:
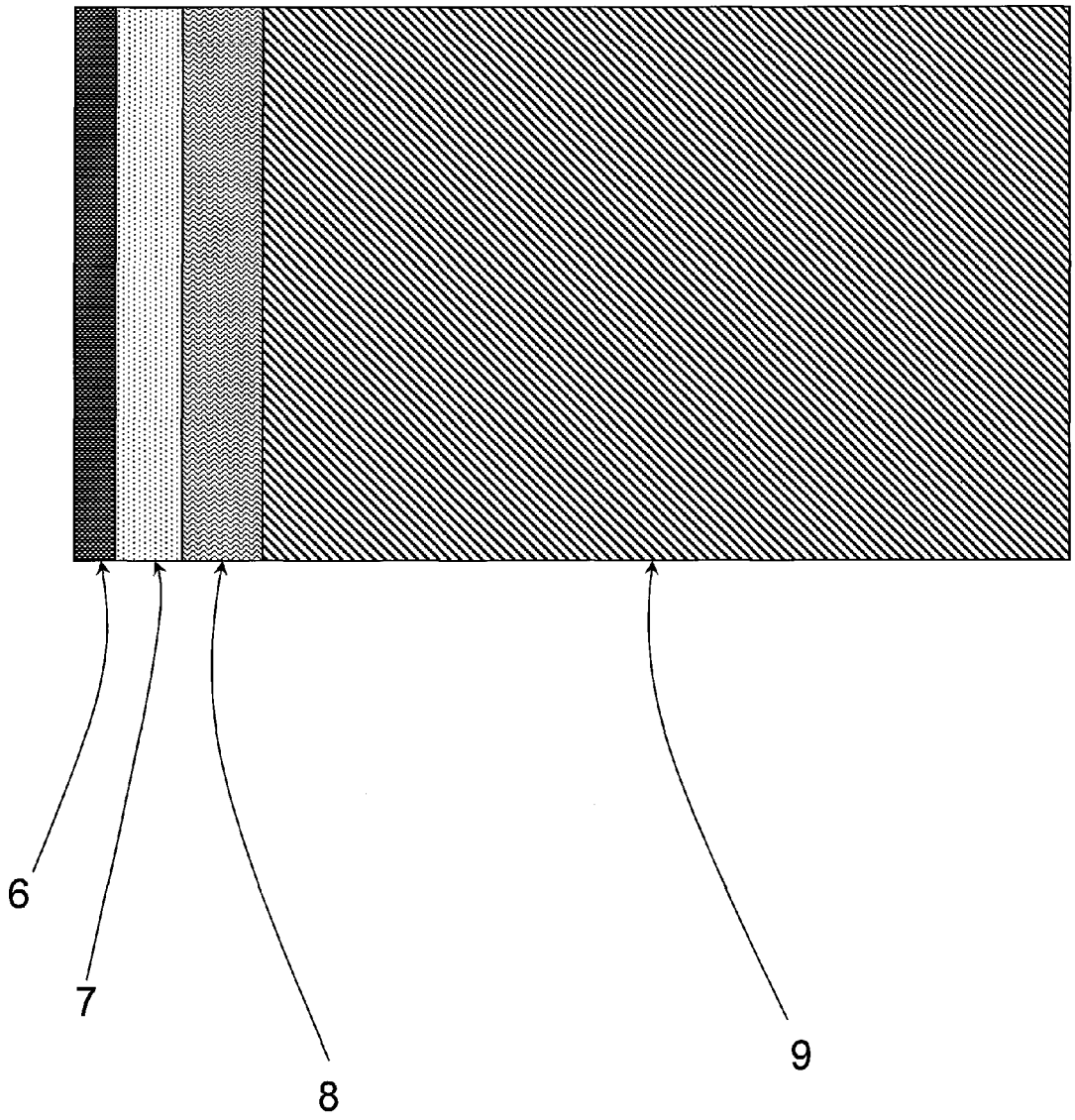
FIG. 3 shows an example of HSUUV armor

Description—FIG. 3—

FIG. 3 depicts a cross section of an example of the preferred embodiment of an HSUUV armor. This example consists of a ¾ inch para-aramid synthetic fiber (e.g., Kevlar™) Liner 6, a one inch layer of 7039 aluminum 7, a 1¼ inch RHA layer 8 and a 12.2 inch layer of ERA 9. Other embodiments of this heavy armor are also possible.

Figure 4:
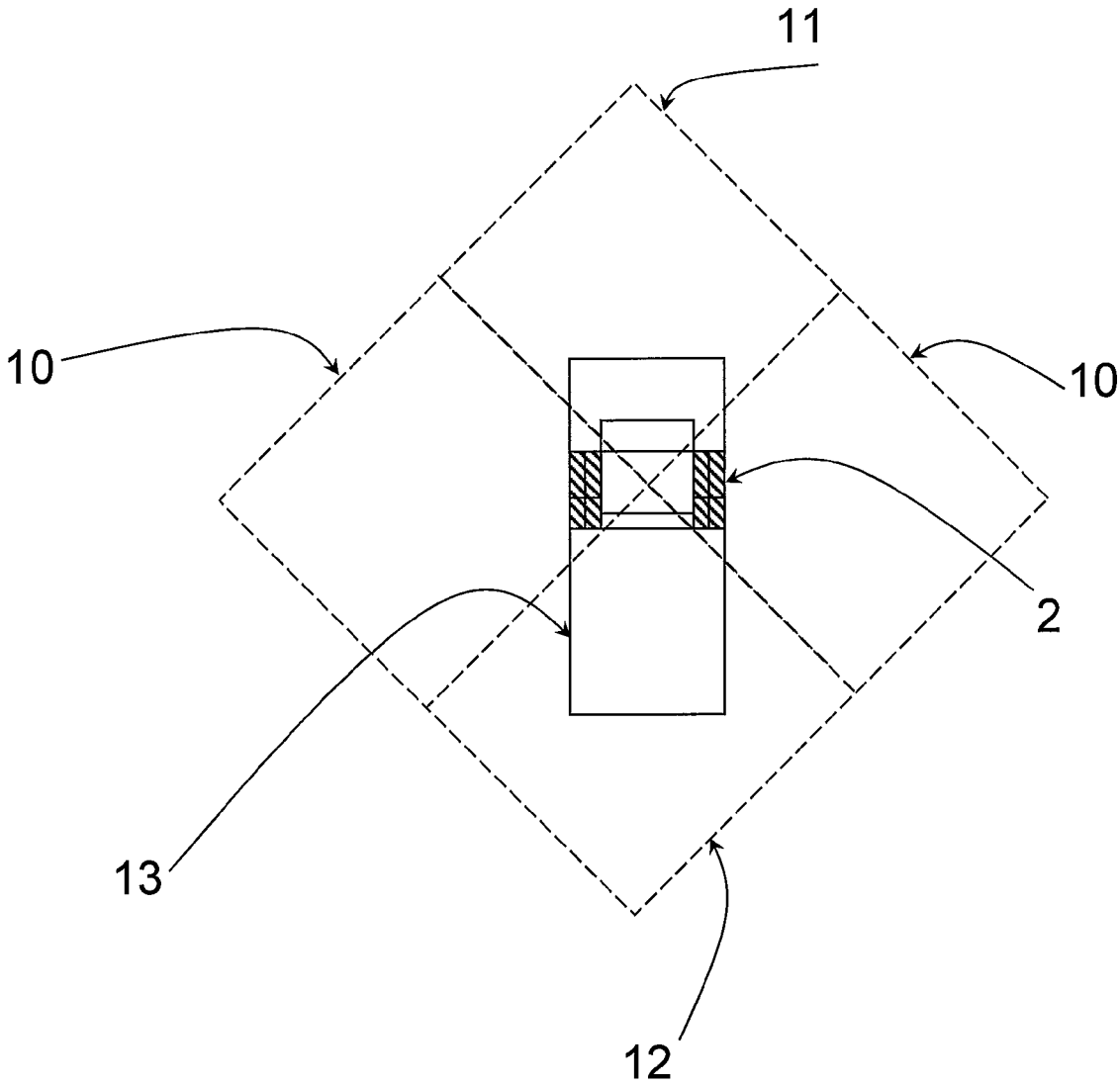
FIG. 4 shows an explanation of the different zones of fire the HSUUV is likely to encounter.

Description—FIG. 4—

FIG. 4 depicts a top down view of the HSUUV with an explanation of the firing zones that the vehicle is likely to encounter. Zone A 10 is where the most fire is anticipated, and thus a huge amount of armor is concentrated. Zone B 11 is the front of the HSUUV, where minimal fire is anticipated and thus light armor is used. Zone C 12 is the back of the HSUUV where light fire is expected and thus light armor is used. Zone D 13 is the underside of the vehicle, which could be vulnerable to improvised explosive devices, thus under armor is installed there. Instead of doors, in the disclosed embodiment, there is an entrance large enough to fit a soldier with gear either in the rear of the cab, the top, or both. As the doors on the HSUUV have been replaced with heavy armor, there is either an entrance in the rear of the cab or through the top, or both. This entrance is large enough for a soldier with gear to enter.

The Highly Survivable Urban Utility Vehicle provides a novel way to balance the concerns of armor, mobility and cost. All vehicles in this context have a maximum weight that they cannot exceed and remain useful. Prior art vehicles distribute this maximum weight evenly. However, the HSUUV strongly protects only those areas that are most likely to be attacked, allowing those areas a level of protection never before possible.

Using the HSUUV, soldiers can safely and quickly enter areas that they otherwise would have had to fight and sustain casualties to enter. This will give US forces an unprecedented amount of flexibility, allowing for better strategic and tactical decisions.

While the above description contains many specificities, these should not be construed as limitations on the scope of the invention, but rather as an exemplification of one of the preferred embodiments. Many other variations are possible, including but not limited to, a HSUUV using a custom made, instead of commercial, vehicle, a HSUUV including an integrated weapons system, or a HSUUV designed to withstand other specific types of weapons.

What is claimed is:

1. A wheeled armored vehicle system, comprising:

a wheeled vehicle having a cab, the cab having two sides, a top, a front, a rear, and a bottom, the cab being a central portion of the vehicle for substantially surrounding one or more passengers;

heavy armor disposed on select areas of the vehicle including at least portions of the two sides of the cab; and light armor disposed on select areas of the vehicle including select areas of the cab.

2. The wheeled armored vehicle system of claim 1, wherein the heavy armor includes:

two side plates, each side plate being disposed on a side of the cab;

two front plates, each front plate being disposed on a distal end of the front of the cab, each front plate extending from a portion of one of the side plates toward a central axis of the cab; and two rear plates, each rear plate being disposed on a distal end of the rear of the cab, each rear plate extending from a portion of one of the side plates toward a central axis of the cab.

3. The wheeled armored vehicle of claim 2, wherein the side plates are thicker than the front plates and the rear plates.

4. The wheeled armored vehicle of claim 1, wherein the heavy armor comprises a layer of a synthetic fiber, a layer of aluminum, a layer of rolled homogenous armor, and a layer of explosive reactive armor.

5. The wheeled armored vehicle of claim 4, wherein a surface of the layer of synthetic fiber immediately contacts a first surface of the layer of aluminum, a second surface of the layer of aluminum immediately contacts a first surface of the layer of rolled homogenous armor, and a second surface of the layer of rolled homogenous armor immediately contacts a surface of the layer of explosive reactive armor.

6. The wheeled armored vehicle of claim 1, wherein the heavy armor is about fifteen inches thick.

7. The wheeled armored vehicle system of claim 1, wherein the wheeled vehicle is a commercial wheeled vehicle designed with at least one door disposed on a side, and wherein the heavy armor replaces the door.

8. The wheeled armored vehicle of claim 1, wherein the vehicle is a commercial wheeled vehicle and wherein the heavy armor is substantially disposed on the interior of the cab, thereby maintaining the appearance of the commercial vehicle from the exterior.

9. The wheeled armored vehicle of claim 1, wherein the heavy armor has a mass greater than seventy pounds per square foot and a thickness of greater than three inches.

10. A wheeled armored vehicle system, comprising:

a wheeled vehicle having a cab, the cab having two sides, a top, a front, a rear, and a bottom, the cab being a central portion of the vehicle for substantially surrounding one or more passengers;

heavy armor disposed on select areas of the vehicle including at least portions of the two sides of the cab; and light armor disposed on select areas of the vehicle including select areas of the cab, wherein the heavy armor is of sufficient weight that if heavy armor were disposed on the two sides, the top, the front, the rear, and the bottom of the cab, the wheeled vehicle would exceed its maximum weight and be rendered not useful.

11. The wheeled vehicle system of claim 10, wherein the heavy armor is of sufficient weight and thickness to stop armor piercing rounds.

12. The wheeled vehicle system of claim 10, wherein the heavy armor is approximately sixteen inches thick.

* * * * *